US008282340B2

(12) United States Patent
Kim et al.

(10) Patent No.: US 8,282,340 B2
(45) Date of Patent: Oct. 9, 2012

(54) TURBO-MACHINE HAVING BELLOWS UNIT FOR AUTOMATIC AXIAL THRUST CONTROL

(75) Inventors: Dae-Jin Kim, Daejeon (KR); Jinhan Kim, Daejeon (KR)

(73) Assignee: Korea Aerospace Research Institute, Daejeon (KR)

( * ) Notice: Subject to any disclaimer, the term of this patent is extended or adjusted under 35 U.S.C. 154(b) by 640 days.

(21) Appl. No.: 12/493,353

(22) Filed: Jun. 29, 2009

(65) Prior Publication Data

US 2010/0329845 A1 Dec. 30, 2010

(51) Int. Cl.
*F01D 3/00* (2006.01)

(52) U.S. Cl. ..... 415/106

(58) Field of Classification Search ..... 415/104, 415/106, 107, 231

See application file for complete search history.

(56) References Cited

U.S. PATENT DOCUMENTS 7,354,240 B2 * 4/2008 Choi et al. ..... 415/104

* cited by examiner

*Primary Examiner* — Richard Edgar
(74) *Attorney, Agent, or Firm* — Rabin & Berdo, P.C.

(57) ABSTRACT

A turbo-machine including a volute casing, a rotating shaft, an impeller, seals, an axial thrust control member and a bellows unit. The volute casing defines therein a fluid passage. The rotating shaft is rotatably provided in the volute casing. The impeller is coupled to the rotating shaft to draw fluid using centrifugal force. The seals are provided around the front and rear ends of the impeller to prevent leakage of fluid. The axial thrust control member is installed in the volute casing behind the impeller. The bellows unit includes the piston installed in the volute casing in a shape surrounding a circumferential outer surface of the axial thrust control member; and a bellows connected with one surface of the piston, the bellows having the predetermined elasticity; and an internal space, between the piston and the volute casing, isolated from the fluid drawn behind the impeller.

5 Claims, 11 Drawing Sheets

TURBO-MACHINE HAVING BELLOWS UNIT FOR AUTOMATIC AXIAL THRUST CONTROL

BACKGROUND OF THE INVENTION

1. Field of the Invention

The present invention relates generally to centrifugal turbo-machines and, more particularly, to a centrifugal turbo-machine in which an axial thrust control member is configured to automatically control axial thrust generated by a difference between static pressures of front and rear ends of an impeller provided in a centrifugal pump or compressor, thus appropriately controlling axial thrust even if the axial thrust varies attributable to abnormal operation conditions.

2. Description of the Related Art

Generally, a centrifugal turbo-machine is a machine which applies kinetic energy (dynamic pressure) to fluid using reaction induced by rotation of an impeller and converts it into pressure energy (static pressure). A centrifugal pump, a centrifugal compressor or the like is a representative example of the centrifugal turbo-machine.

FIG. 1 is a sectional view showing the construction of a centrifugal turbo-machine 10 according to a conventional technique.

Referring to FIG. 1, the conventional centrifugal turbo-machine 10 which converts kinetic energy applied to fluid into pressure energy includes a rotating shaft 12, an impeller 13, a volute casing 11 and seals 14 and 15. The rotating shaft 12 is rotatably installed in the volute casing 11 and supported by a bearing 16.

The impeller 13 is fastened to the rotating shaft 12 and rotates along with the rotating shaft 12. The impeller 13 draws fluid using centrifugal force generated by rotation thereof.

The volute casing 11 defines therein a space into which fluid drawn by the impeller 13 flows. In the volute casing 11, dynamic pressure of drawn fluid is converted into static pressure. In other words, in the volute casing 11, kinetic energy of drawn fluid is converted into pressure energy.

The seals 14 and 15 reduce the amount of leakage of drawn fluid to increase the efficiency of the centrifugal turbo-machine 10. The seals 14 and 15 are positioned corresponding to the front and rear ends of the impeller 13.

The operation of the conventional centrifugal turbo-machine 10 having the above-mentioned construction will be explained below.

The impeller 13 rotates in the hermetically sealed volute casing 11 to draw fluid into the volute casing 11. Then, centrifugal force is generated by the impeller 13. Fluid is drawn into the volute casing 11 by the centrifugal force of the impeller 13. While the drawn fluid flows into the volute casing 11, dynamic pressure of fluid is converted into static pressure in the volute casing 11, thus producing pressure energy.

However, some of fluid drawn by the impeller 13 flows through gaps between the surface of the impeller 13 and the seals 14 and 15 rather than being drawn into the volute casing 11. Fluid passing through the gaps defined by the seals 14 and 15 differ in pressure from each other, thus generating axial thrust.

As shown in FIG. 1, the shapes of the front and rear ends of the impeller 13 differ from each other and the area of the gap between each end of the impeller 13 and its surrounding casing also have difference. Thus, pressures formed around the front and rear ends of the impeller 13 differ from each other. Furthermore, pressures around outlets of the seals 14 and 15 differ from each other. Therefore, axial thrust is generated in a direction from the rear end of the impeller 13 towards the front end thereof.

This axial thrust is applied to the rotating shaft 12 of the centrifugal turbo-machine 10. The force applied to the rotating shaft 12 is supported by the bearing 16 coupled to the impeller 13.

Here, in the case where appropriate intensity of axial thrust is applied to the rotating shaft 12, the bearing 16 can reliably support the rotating shaft 12. However, if excessive axial thrust is applied to the rotating shaft 12, the expected lifetime of the bearing 16 is reduced. If it exceeds a limit, the bearing 16 may be damaged.

Therefore, to prevent damage of the turbo-machine 10 and increase the lifetime of the bearing 16, the axial thrust should be successfully controlled. For this, a difference between static pressures applied to the front and rear ends of the impeller 13 must be reduced.

In the conventional technique, to reduce a difference between static pressures applied to the front and rear ends of the impeller 13, the area of gap between the impeller 13 and the volute casing 11 was changed by varying the diameters of the seals 14 and 15 provided around the front and rear ends of the impeller 13.

In detail, the conventional technique has used a method in which the intensity of axial thrust generated around the rear end of the impeller 13 is reduced by increasing the diameter of the seal 15 provided around the rear end of the impeller 13 which typically generates relatively large axial thrust. However, the method of reducing axial thrust by changing the diameter of the seal 15 requires much time and costs in manufacturing the turbo-machine, so that it is not economic.

Recently, in an effort to overcome the above problem of poor economy, a method of installing an axial thrust control member for controlling axial thrust in a turbo-machine has been developed.

FIG. 2 is a sectional view showing a turbo-machine 20 having an axial thrust control member 30 according to a conventional technique.

Referring to FIG. 2, the turbo-machine 20 having the axial thrust control member 30 can more economically control axial thrust, compared to the prior method of changing the diameter of the seal. However, if input values different from the input values it was designed for are applied to the turbo-machine 20 while it is being operated, an operational problem may be induced. Furthermore, there is a disadvantage in that the turbo-machine 20 may not be able to resist abnormal operation circumstances.

For example, in the case where a flow rate of fluid drawn into the turbo-machine 20 is less than the flow rate it was designed for, output pressure is increased and a pressure around the impeller 23 is also increased. Thereby, the entire axial thrust applied to the turbo-machine 20 is also increased.

Furthermore, if a design of a fluid supply system for operating the turbo-machine 20 is not appropriate or a loss of pressure of the fluid supply system is increased by penetration of foreign substances while the turbo-machine 20 is being operated, a flow rate of fluid drawn into the turbo-machine 20 becomes less than the designed flow rate and the axial thrust applied to the turbo machine 20 is increased.

In addition, in the case where the design of the impeller 23 or the volute casing 21 does not correspond to the designed flow rate, there is a probability of an increase in output pressure. This also is a factor of an increase in axial thrust.

Moreover, the axial thrust control member 30 cannot automatically control axial thrust while the turbo-machine 20 is being operated. Merely, the height of the rib 31 of the axial thrust control member 30 is determined to a degree capable of reducing axial thrust in consideration of the intensity of axial thrust expected to be generated while the turbo-machine 20 is being operated. Then, pressure of fluid drawn through the rear end of the impeller 23 is reduced by the resistant force of the rib 31, thus controlling axial thrust.

However, to effectively use the axial thrust control member, after a design flow rate of the turbo-machine 20 and output axial thrust are correctly checked, can the turbo-machine 20 be operated. Only then can the generation of expected axial thrust be appropriately controlled.

Furthermore, a problem in an increase of axial thrust exceeding an expected value because of the above several reasons cannot be controlled by the axial thrust control member 30. In this case, in the same manner as the prior turbo-machine 10 having no axial thrust control member, the bearing 26 may be damaged with the result that the lifetime of the turbo-machine is reduced.

As such, in the conventional turbo-machine, when pressure around the seals 24 and 25 is increased over an expected value, the axial thrust control member 30 cannot exhibit its intended function. To improve this, a precise measure of axial thrust is indispensably conducted before the machine is operated. If unexpected measurement results are produced, the design of the axial thrust control member 30 must be revised, or it must be newly manufactured or installed.

SUMMARY OF THE INVENTION

Accordingly, the present invention has been made keeping in mind the above problems occurring in the prior art, and an object of the present invention is to provide a turbo-machine in which protruding heights of ribs provided on an axial thrust control member are automatically controlled depending on an intensity of pressure of fluid drawn behind a rear end of an impeller, so that even though excessive axial thrust greater than a value expected when designing the turbo-machine is generated, the axial thrust can be automatically controlled.

In order to accomplish the above object, the present invention provides a turbo-machine, including: a volute casing defining therein a fluid passage for forming a fluid pressure; a rotating shaft provided in the volute casing so as to be rotatable; an impeller coupled to one end of the rotating shaft to draw fluid using centrifugal force generated by rotation; seals provided around front and rear ends of the impeller to prevent leakage of the fluid; an axial thrust control member installed in the volute casing behind the impeller with respect to a flowing direction of the fluid, the axial thrust control member having an annular planar shape, with a plurality of ribs provided on one surface of the axial thrust control member facing the flowing direction of the fluid such that portions of the ribs are exposed from the surface of the axial thrust control member to impede rotation of the fluid; and a bellows unit, having a piston surrounding a circumferential outer surface of the axial thrust control member, the piston covering the outer surface of the ribs and a bellows connected with one surface of the piston, the bellows having a predetermined elasticity.

The bellows unit is constructed such that the bellows is compressed by pressure of the fluid drawn into the volute casing and the piston automatically moves by a predetermined distance along the axial direction.

The axial thrust control member may be constructed such that the ribs are further exposed from the axial thrust control member by a distance corresponding to the distance that the piston moves along the axial direction, thus increasing resistant force of the ribs impeding the rotation of the fluid.

The piston may have a sealing member to isolate the internal space defined by the piston and the volute casing from fluid drawn behind the impeller.

The bellows unit may be controlled such that a sum of the elastic force of the bellows and a pressure in the internal space is equal to a pressure of the fluid drawn behind the impeller.

In the bellows unit, when the pressure of the fluid drawn behind the impeller is increased, the bellows may be automatically compressed and the resistant force of the ribs provided on the axial thrust control member is thus increased, so that the increased pressure of the fluid is reduced until the sum of the elastic force of the bellows and the pressure in the internal space is equal to the pressure of the fluid drawn behind the impeller.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF THE PREFERRED EMBODIMENTS

Hereinafter, a preferred embodiment of the present invention will be described in detail with reference to the attached drawings. The terms and words used in the specification and claims must not be limited to typical or dictionary meanings, but must be regarded as concepts selected by the inventor as concepts which best illustrate the present invention, and must be interpreted as having meanings and concepts adapted to the scope and spirit of the present invention to aid in understanding the technology of the present invention.

Therefore, the construction of the embodiment illustrated in the specification and the drawings must be regarded as only one illustrative example, and these are not intended to limit the present invention. Furthermore, it must be understood that various modifications, additions and substitutions are possible at the point of time of application of the present invention.

The construction of a turbo-machine having a bellows unit according to the embodiment of the present invention will be described in detail.

Figure 1:
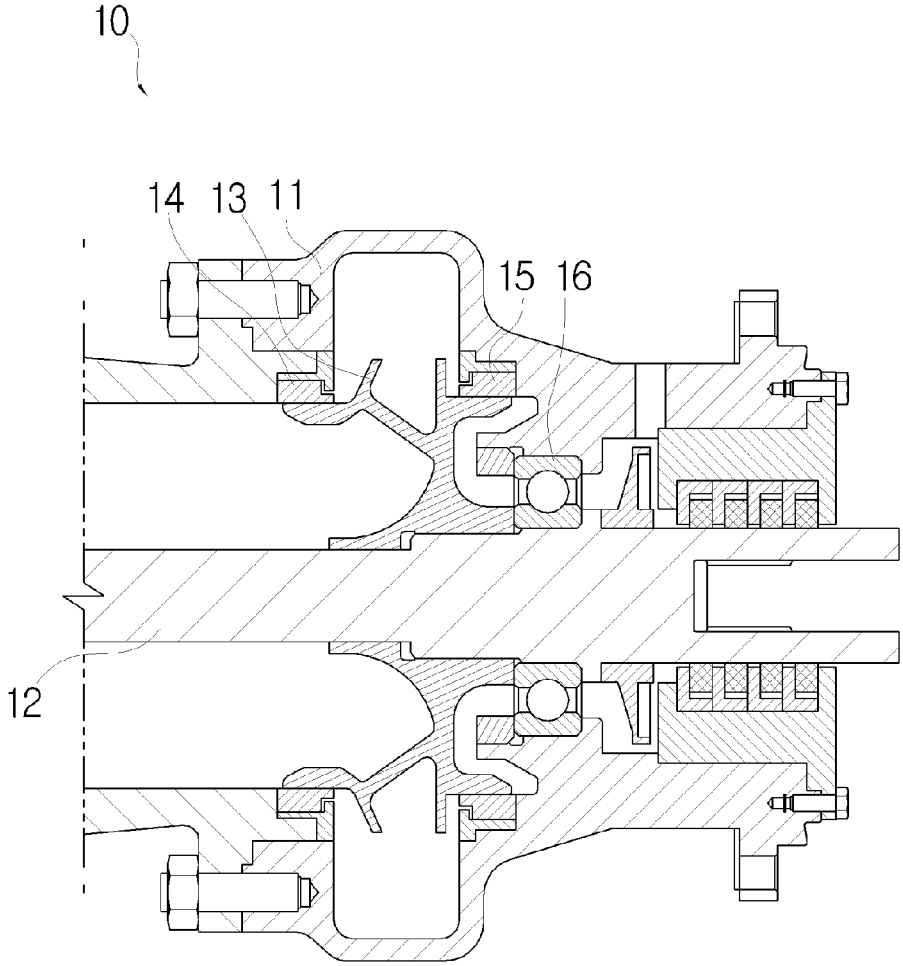
Fig. 1 PRIOR ART
FIG. 1 is a sectional view showing the construction of a centrifugal turbo-machine according to a conventional technique.
Figure 2:
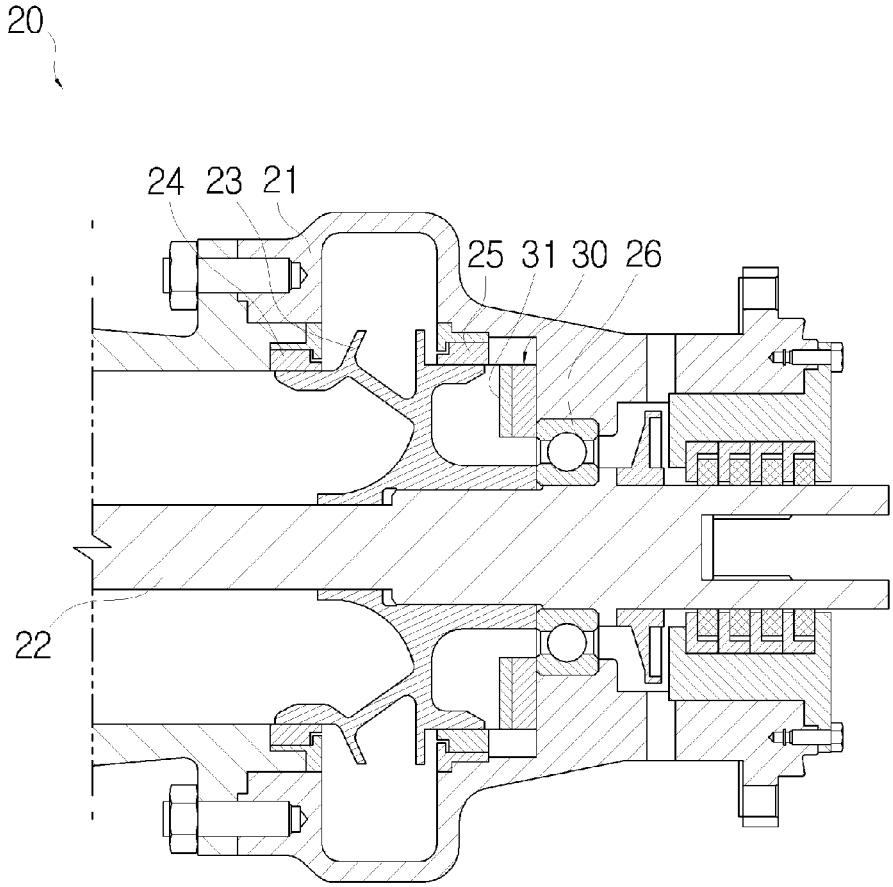
Fig. 2 PRIOR ART
FIG. 2 is a sectional view showing a turbo-machine having an axial thrust control member, according to another conventional technique.
Figure 3:
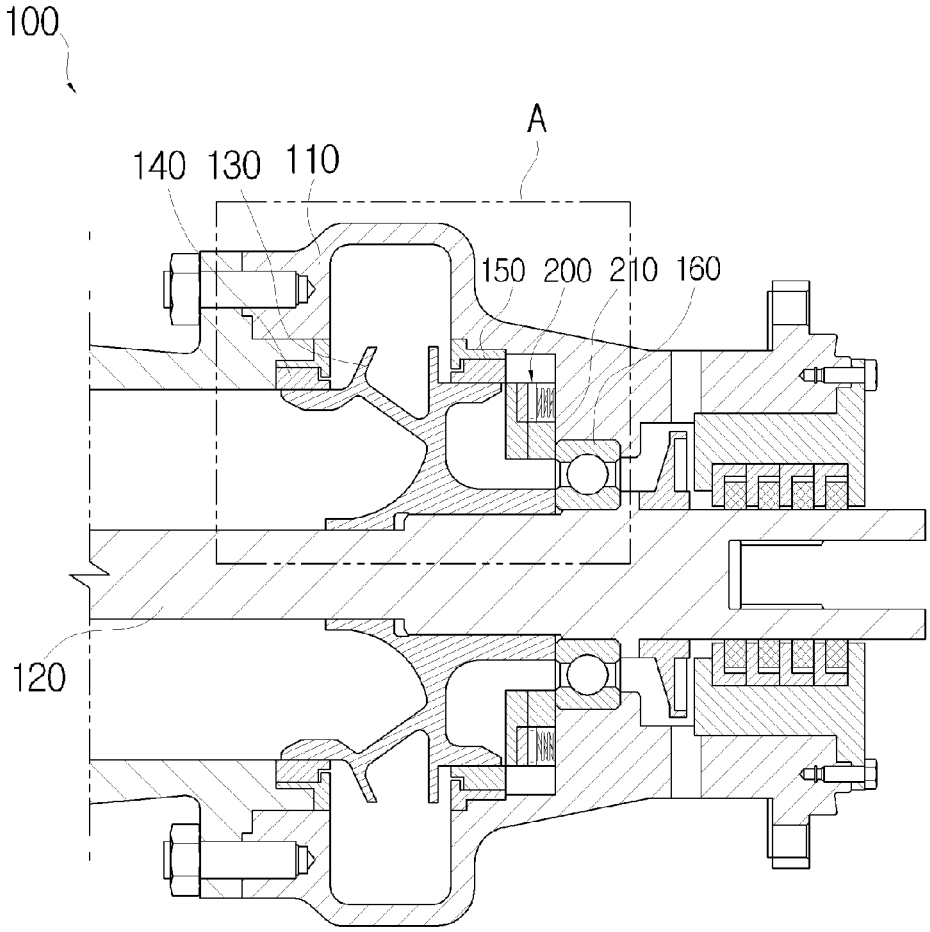
FIG. 3 is a sectional view of a turbo-machine having a bellows unit, according to an embodiment of the present invention.
Figure 8:
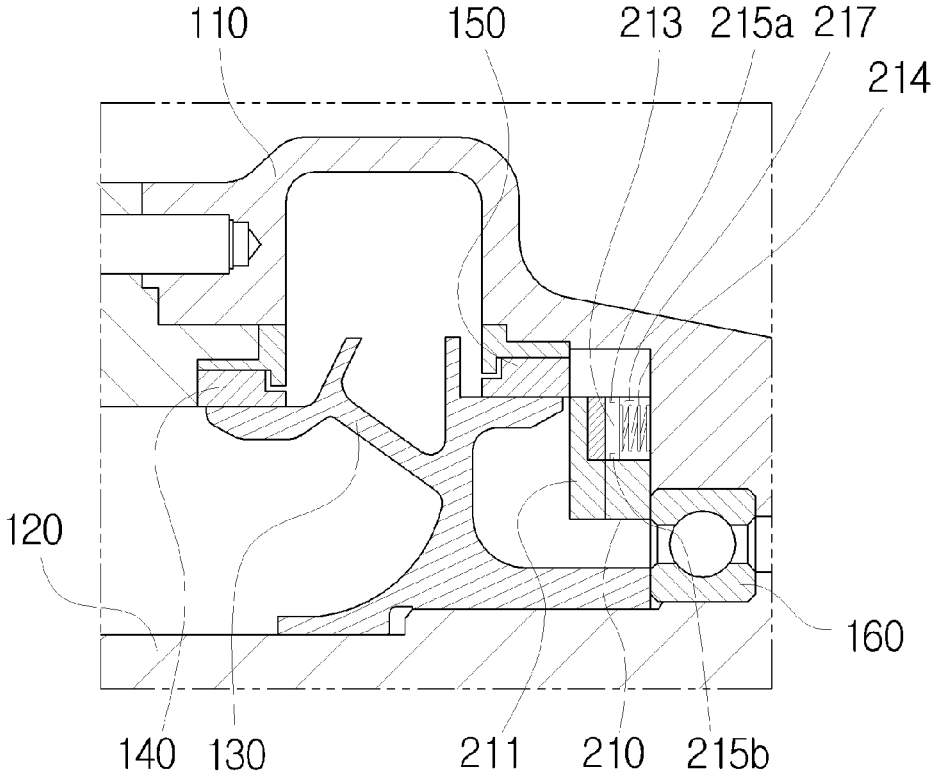
FIG. 8 is an enlarged sectional view of the portion A of FIG. 3 when the bellows unit is not in operation according to the embodiment of the present invention.

FIG. 3 is a sectional view of the turbo-machine 100 having the bellows unit 200, according to the embodiment of the present invention. FIG. 8 is an enlarged sectional view of the portion A of FIG. 3 when the bellows unit 200 is not in operation.

Referring to FIGS. 3 and 8, the turbo-machine 100 according to the embodiment of the present invention includes a volute casing 110, a rotating shaft 120, an impeller 130, seals 140 and 150, an axial thrust control member 210 and a bellows unit 200.

The functions and operation of the volute casing 110, the rotating shaft 120, the impeller 130 and the seals 140 and 150 are the same as those of the corresponding elements of the conventional turbo-machine 20 having the turbo-machine 10 and the axial thrust control member, therefore further explanation is deemed unnecessary.

Figure 4:
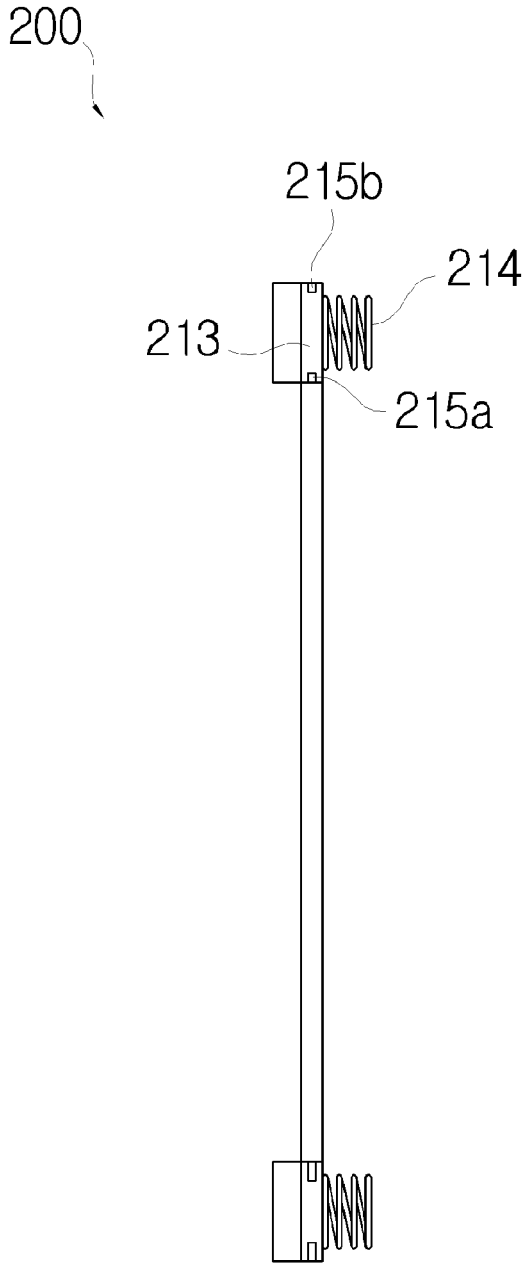
FIG. 4 is a sectional view illustrating an axial thrust control member according to the embodiment of the present invention.
Figure 5:
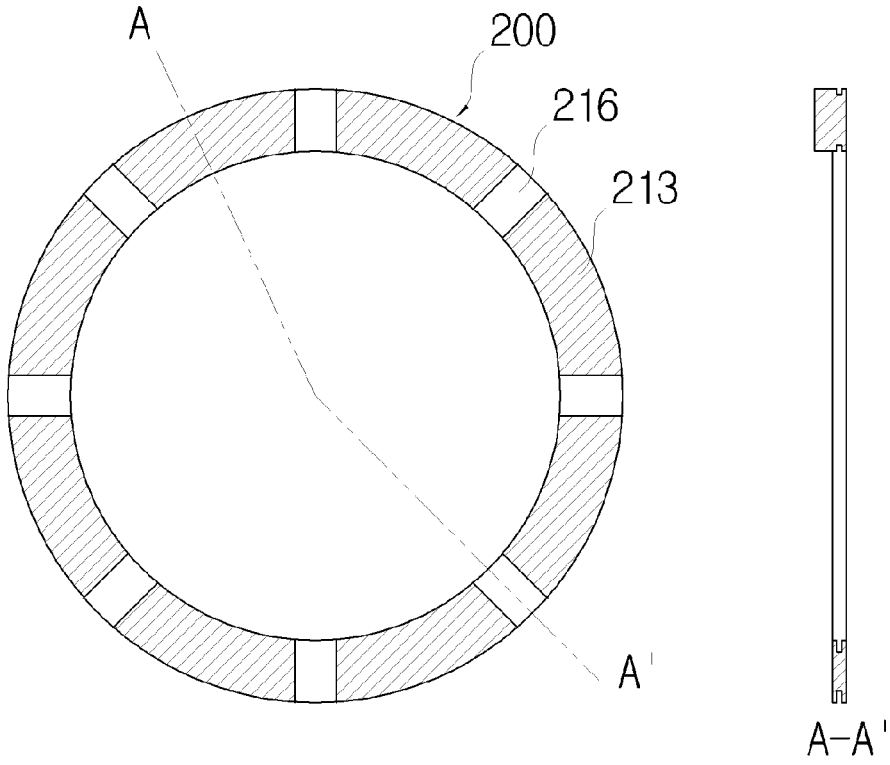
FIG. 5 is a sectional and front view illustrating the piston which moves by the elastic force of the bellows and the insert hole which couples with the ribs of the axial thrust control member.
Figure 6:
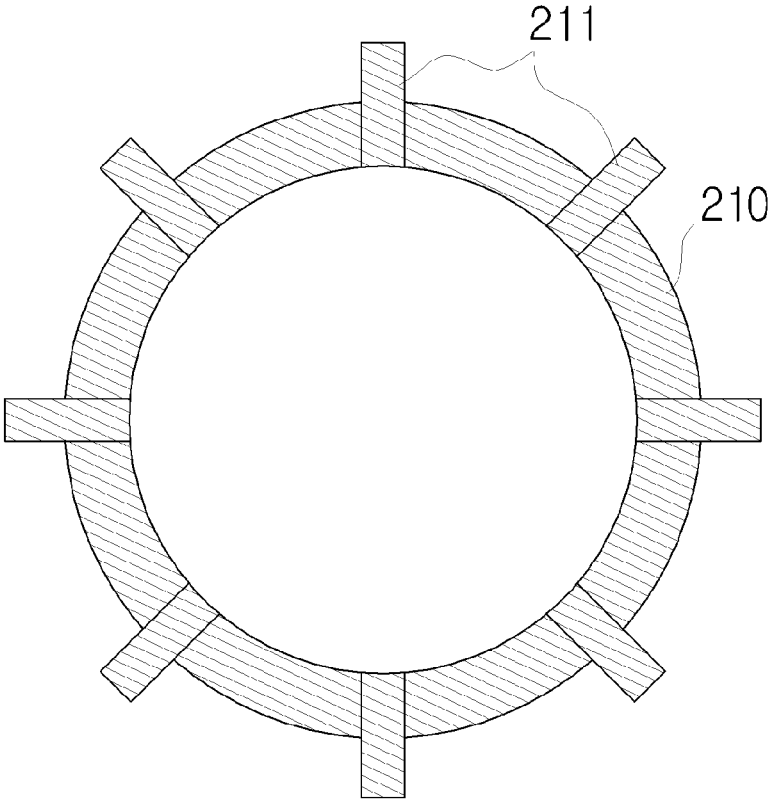
FIG. 6 is a front view illustrating the construction of the axial thrust control member according to the embodiment of the present invention.
Figure 7:
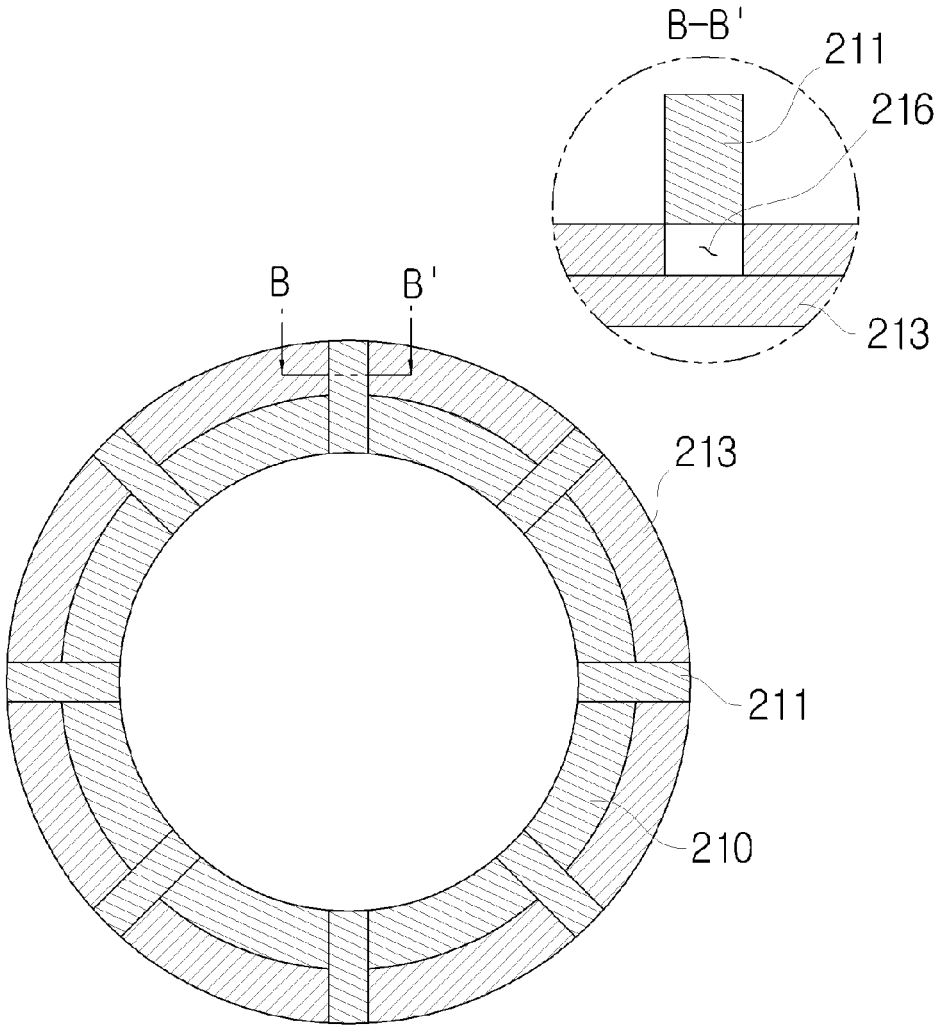
FIG. 7 is a front view and an enlarged view showing the coupling between the axial thrust control member and the bellows unit according to the embodiment of the present invention.

FIG. 4 is a sectional view of an axial thrust control member 210 according to the embodiment of the present invention. FIG. 5 is a sectional and front view illustrating the piston 213 which moves by the elastic force of the bellows 214 and the insert hole 216 which couples with the ribs of the axial thrust control member 210. FIG. 6 is a front view illustrating the construction of the axial thrust control member 210 according to the embodiment of the present invention. FIG. 7 is a front view and an enlarged view showing the coupling between the axial thrust control member 210 and the bellows unit 200.

Referring to FIGS. 4 through 7, the axial thrust control member 210 comprises an annular planar member. A plurality of ribs 211 protrudes from one surface of the axial thrust control member 210 which faces the flow of fluid in order to reduce a difference in static pressure between the front and rear ends of the impeller 130 and thus control axial thrust.

Here, the axial thrust control member 210 reduces an angular velocity component of fluid generated by the rotation of the impeller 130 and thus controls pressure around the rear end of the impeller 130. The effect of pressure control is determined by the shape of the axial thrust control member 210.

Preferably, the height to which each rib 211 protrudes and the number of ribs 211 are determined in consideration of both a flow rate of fluid to be drawn when the turbo-machine 100 is being operated and the intensity of axial thrust to be generated.

As the height to which each rib 211 protrudes is increased, the extent of decrease in the pressure of fluid to be drawn is increased. As the height to which each rib 211 protrudes is reduced, the extent of decrease in the pressure of fluid to be drawn is also reduced.

Furthermore, as the number of ribs 211 is increased, the amount of decrease in pressure of fluid to be drawn is increased. As the number of ribs 211 is decreased, the extent of decrease in the pressure of fluid to be drawn is also reduced.

Meanwhile, the bellows unit 200 includes a piston 213 which has an annular planar shape and surrounds the circumferential outer surface of the axial thrust control member 210 and covers the outer surface of the rib 211 and a bellows 214 which is connected with one surface of the piston and has a predetermined elasticity.

Furthermore, rib insert holes 216, the number of which is the same as that of ribs 211, are formed in one surface of the piston 213, so that the ends of the ribs 211 which protrude from the axial thrust control member 210 are respectively inserted into the rib insert holes 216.

The piston 213 has at edges thereof sealing members 215*a* and 215*b* which isolate the internal space 217 from the outside such that the pressure of the internal space 217 is maintained at atmospheric pressure.

As such, the pressure inside the piston 213, that is, the pressure in the internal space 217, is maintained at atmospheric pressure. The pressure outside the piston 213 varies depending on the pressure of drawn fluid. Therefore, different pressures are applied to the inside and the outside of the piston 213.

With regard to the atmospheric pressure state in the internal space 217, it is preferable that when the piston 213 is installed in the volute casing 110, the internal space 217 defined by the piston 213 be sealed in the atmospheric pressure state. However, the present invention is not limited to this. The initial pressure in the internal space 217 may be determined depending on the amount of fluid drawn into the volute casing 110 and the intensity of fluid pressure.

In the bellows unit 200, the bellows 214 is compressed by the pressure of fluid drawn into the volute casing 110 so that the piston 213 moves automatically by a predetermined distance.

Furthermore, the ribs 211 of the axial thrust control member 210 are further exposed at heights corresponding to the distance that the piston 213 moves along the axial direction. Thus, force resistant to rotation of fluid by the impeller 130 is increased by the ribs 211.

The operation principle of the turbo-machine 100 having the bellows unit 200 according to the embodiment of the present invention will be described below.

Figure 9:
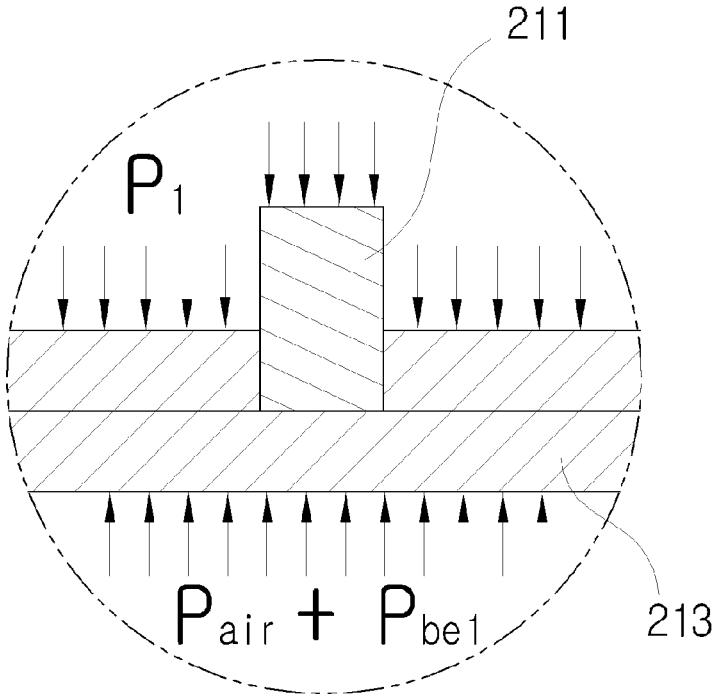
FIG. 9 is a view corresponding to the sectional view taken along the line B-B' of FIG. 7 when the bellows unit is not in operation according to the embodiment of the present invention.
Figure 10:
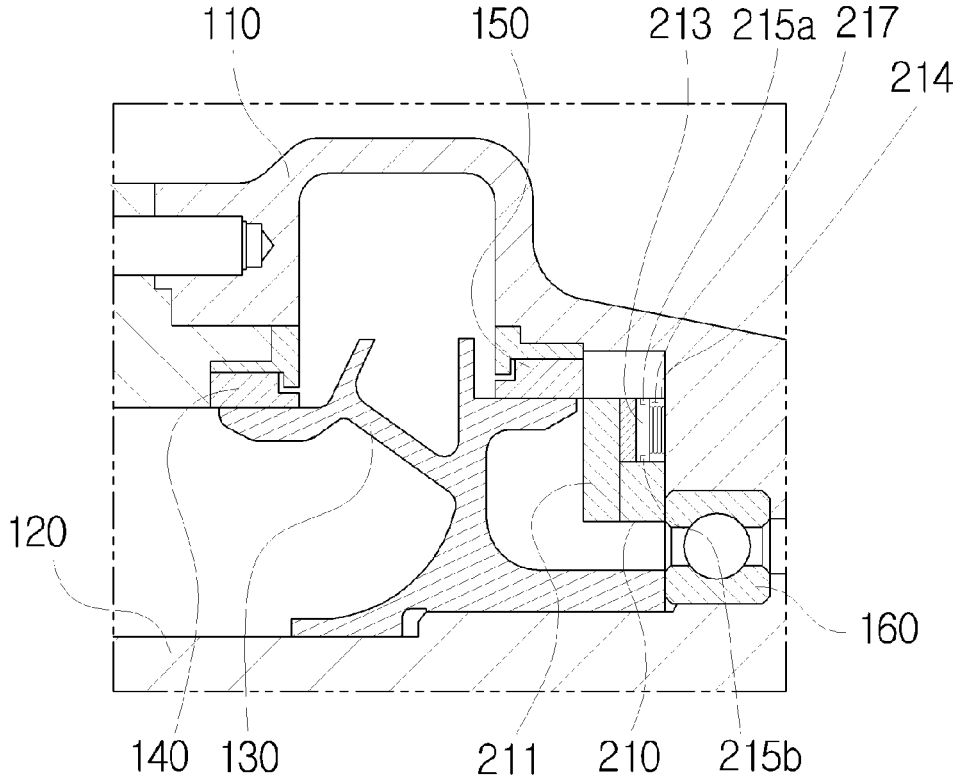
FIG. 10 is an enlarged sectional view of the portion A of FIG. 3 when the bellows unit is in operation according to the embodiment of the present invention.
Figure 11:
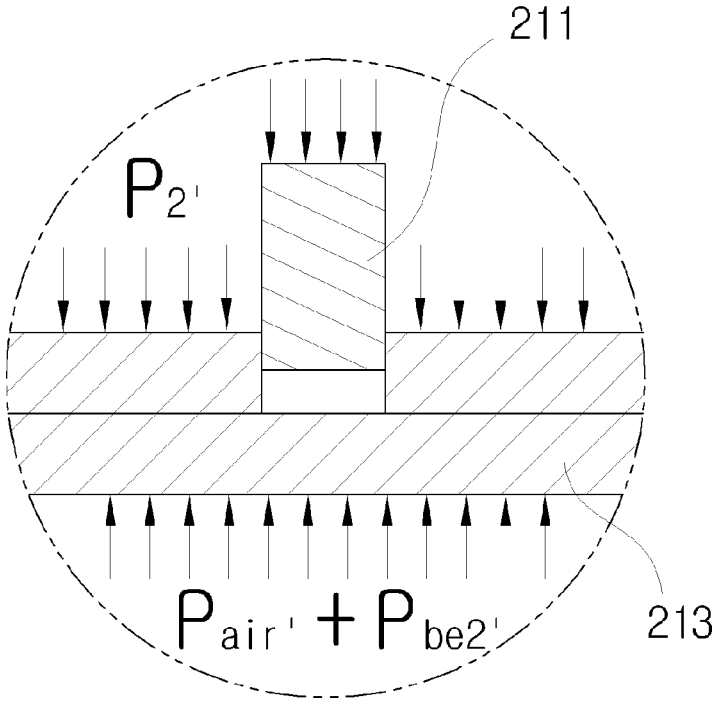
FIG. 11 is a view corresponding to the sectional view taken along the line B-B' of FIG. 7 when the bellows unit is in operation according to the embodiment of the present invention.

FIG. 8 is an enlarged sectional view of the portion A of FIG. 3 when the bellows unit 200 is not in operation according to the embodiment of the present invention. FIG. 9 is a view corresponding to the sectional view taken along the line B-B' of FIG. 7 when the bellows unit 200 is not in operation according to the embodiment of the present invention. FIG. 10 is an enlarged sectional view of the portion A of FIG. 3 when the bellows unit 200 is in operation according to the embodiment of the present invention. FIG. 11 is a view corresponding to the sectional view taken along the line B-B' of FIG. 7 when the bellows unit 200 is in operation according to the embodiment of the present invention.

Referring to FIGS. 8 and 9, when the turbo-machine 100 of the present invention is in operation within expected design parameters, axial thrust generated is controlled in such a way that the ribs 211 exposed from the surface of the axial thrust control member 210 impede rotation of fluid to reduce an angular speed of the fluid, and further so that static pressure of fluid around the rear end of the impeller 130 rapidly reduces.

Here, in the bellows unit 200, the bellows 214 and the piston move as shown in FIG. 9 in order that the sum of a pressure $P_{be1}$ applied to the piston 213 by the bellows 214 and an atmospheric pressure $P_{air}$ formed in the internal space 217 defined by the piston 213 is equilibrated with a pressure $P_1$ of fluid drawn behind the rear end of the impeller 130.

In other words, the bellows unit 200 is constructed such that the sum of the elastic force of the bellows 214 provided in the internal space 217 defined by the piston 213 and the pressure in the internal space 217 is the same as the pressure of fluid drawn behind the rear end of the impeller 130.

Meanwhile, in the case where the turbo-machine 100 is operated under unexpected conditions so that the output pressure of the impeller 130 becomes higher than the expected value, as shown in FIGS. 10 and 11, the pressure $P_2$ of fluid drawn behind the rear end of the impeller 130 is also increased ($P_{2'}>P_1$). Thereby, the piston 213 automatically moves along the axial direction. Thus, the protruding heights of the ribs 211 of the axial thrust control member 210 are relatively increased.

In other words, when the pressure of fluid drawn behind the rear end of the impeller 130 is increased, the piston 213 of the bellows unit 200 automatically moves. Thus, the resistant force of the ribs 211 of the axial thrust control member 210 is increased and the fluid pressure which has been increased is reduced. Therefore the ribs 211 have been relatively increased in height function to reduce the pressure of fluid behind the seal 150 and prevent excessive axial thrust from being applied to a pump rotor.

At that time, the bellows 214 is compressed according to the movement of the piston 213 and the elasticity of the bellows increases. Also, the pressure of the internal space 217 increases due to the shrink of the volume.

Ultimately, the position of the piston 213 is determined as a position at which the pressure of fluid drawn behind the rear end of the impeller 130 is equilibrated with the sum of the elastic force of the bellows 214 and the pressure in the internal space 217 ($P_2=P_{be2}+P_{air}$, $P_2<P_{2'}$).

As such, even in unexpected conditions, the turbo-machine 100 can automatically control the axial thrust. Therefore, the present invention can be free from a problem pertaining to the axial thrust which limits the design of the turbo-machine 100. Furthermore, by virtue of the automatic control of the axial thrust, the lifetime of the bearing 160 of the turbo-machine 100 can be increased.

As described above, in the turbo-machine according to the present invention, a bellows unit can automatically reduce a difference in static pressure of drawn fluid depending on the intensity of pressure of the fluid. Therefore, the turbo-machine can be more reliably and smoothly operated.

Furthermore, because axial thrust can be automatically controlled, damage of elements, such as a bearing, etc., can be prevented. Thus, the durability of the turbo-machine can be enhanced.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A turbo-machine, comprising:

a volute casing defining therein a fluid passage for forming a fluid pressure;

a rotating shaft provided in the volute casing so as to be rotatable;

an impeller coupled to one end of the rotating shaft to draw fluid using centrifugal force generated by rotation;

seals provided around front and rear ends of the impeller to prevent leakage of the fluid;

an axial thrust control member installed in the volute casing behind the impeller with respect to a flowing direction of the fluid, the axial thrust control member having an annular planar shape, with a plurality of ribs provided on one surface of the axial thrust control member facing the flowing direction of the fluid such that portions of the ribs are exposed from the surface of the axial thrust control member to impede rotation of the fluid; and a bellows unit, comprising: a piston having an annular planar shape, the piston installed in the volute casing in a shape surrounding a circumferential outer surface of the axial thrust control member; and a bellows connected with one surface of the piston, the bellows having the predetermined elasticity; and an internal space, between the piston and the volute casing, isolated from the fluid drawn behind the impeller, wherein the bellows unit is constructed such that the bellows is compressed by pressure of the fluid drawn into the volute casing, the piston moves by a predetermined distance along the axial direction and thus the resistant force of the rib impeding the rotation of the fluid is increased.

2. The turbo-machine as set forth in claim 1, wherein the bellows unit is controlled and the components of the bellows unit are automatically positioned such that a sum of the elastic force of the bellows and a pressure in the internal space is equal to a pressure of the fluid drawn behind the impeller.

3. The turbo-machine as set forth in claim 2, wherein in the bellows unit, the bellows is compressed by the pressure of the drawn fluid and the piston moves automatically, so the pressure of the rear impeller cavity is controlled and the axial thrust of the rotational part can be maintained in the predetermined value even if unexpected condition.

4. The turbo-machine as set forth in claim 3, wherein the axial thrust control member is constructed such that the ribs are further exposed from the axial thrust control member by a distance corresponding to the distance that the pistons moves in the flowing direction of the fluid, thus increasing resistant force of the ribs impeding the rotation of the fluid.

5. The turbo-machine as set forth in claim 4, wherein the piston has a sealing member to isolate the internal space defined by the piston from fluid drawn behind the impeller.

* * * * *